US008851912B2

(12) United States Patent
Zhang

(10) Patent No.: US 8,851,912 B2
(45) Date of Patent: Oct. 7, 2014

(54) POWER SOCKET HAVING AN ELECTROMAGNETIC POP-UP MECHANISM

(71) Applicants: Fu Tai Hua Industry (Shenzhen) Co., Ltd., Shenzhen (CN); Hon Hai Precision Industry Co., Ltd., New Taipei (TW)

(72) Inventor: Jun-Liang Zhang, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/794,803

(22) Filed: Mar. 12, 2013

(65) Prior Publication Data

US 2013/0244462 A1 Sep. 19, 2013

(30) Foreign Application Priority Data

Mar. 13, 2012 (CN) ..... 2012 1 0064845

(51) Int. Cl.

| | |
|---|---|
| ***H01R 13/62*** | (2006.01) |
| ***H01R 13/633*** | (2006.01) |
| ***H01R 13/635*** | (2006.01) |
| *H01R 103/00* | (2006.01) |
| *H01R 24/76* | (2011.01) |

(52) U.S. Cl.

CPC ..... *H01R 13/633* (2013.01); *H01R 2103/00* (2013.01); *H01R 13/6205* (2013.01); *H01R 24/76* (2013.01); *H01R 13/635* (2013.01)

USPC ..... 439/159

(58) Field of Classification Search

None

See application file for complete search history.

(56) References Cited

U.S. PATENT DOCUMENTS

| | | | | |
|---|---|---|---|---|
| 7,331,793 | B2 * | 2/2008 | Hernandez et al. | 439/38 |
| 7,351,066 | B2 * | 4/2008 | DiFonzo et al. | 439/39 |
| 2006/0166533 | A1 * | 7/2006 | Muramatsu et al. | 439/160 |
| 2012/0220162 | A1 * | 8/2012 | Zhou et al. | 439/501 |
| 2013/0157488 | A1 * | 6/2013 | Zhang et al. | 439/160 |
| 2013/0260584 | A1 * | 10/2013 | Zhang et al. | 439/159 |
| 2014/0092535 | A1 * | 4/2014 | Chou et al. | 361/679.01 |

* cited by examiner

*Primary Examiner* — Chandrika Prasad

(74) *Attorney, Agent, or Firm* — Novak Druce Connolly Bove + Quigg LLP

(57) ABSTRACT

An exemplary electrical connector assembly includes a power plug and a power socket. The power plug includes a magnet. The power socket includes a pop-up mechanism. The pop-up mechanism includes a sliding assembly which can be switched from a first position to a second position. When the sliding assembly is switched from the first position to the second position, the pop-up mechanism generates a magnetic field which repels the magnet of the power plug, and the power plug moves away from the power socket.

20 Claims, 9 Drawing Sheets

POWER SOCKET HAVING AN ELECTROMAGNETIC POP-UP MECHANISM

BACKGROUND

1. Technical Field

The present disclosure generally relates to electrical connector assemblies, and more particularly, to an electrical connector assembly with magnetic assist for unplugging of a power plug from a power socket.

2. Description of Related Art

Most electronic devices have power plugs to connect to power sockets for receiving electricity. After the electronic device is switched off, the power plug may need to be manually unplugged, which, in the case of a tight fit, can be strenuous and inconvenient.

What is needed, therefore, is a means which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Reference will be made to the drawings to describe various embodiments.

Figure 1:
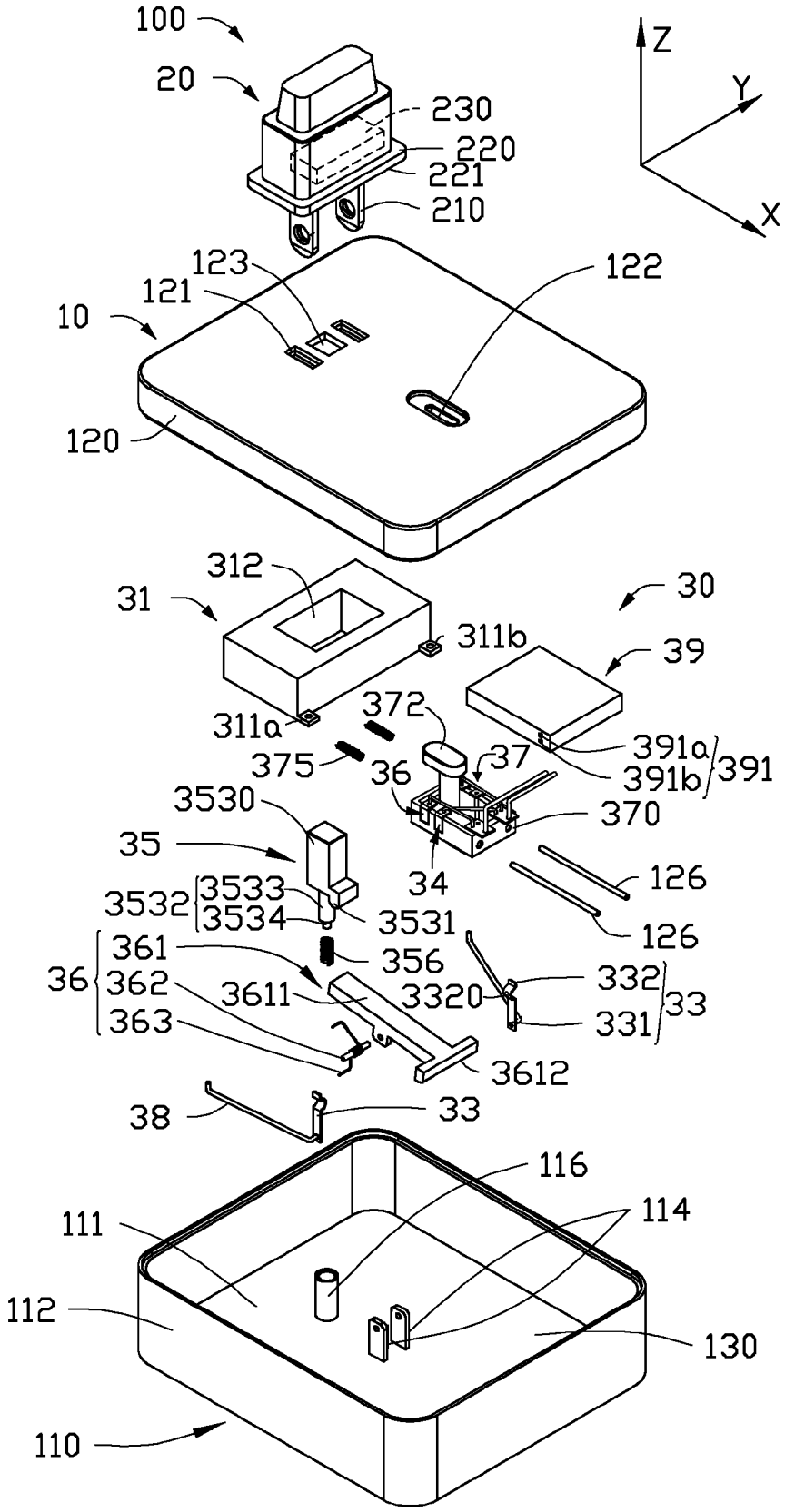
FIG. 1 is an exploded view of an exemplary embodiment of an electrical connector assembly, the electrical connector assembly including a power plug, a top cover, a battery, and a sliding assembly.

Referring to FIG. 1, in one embodiment, an electrical connector assembly 100 includes a power plug 20 connected to an electronic device via a cable and a power socket 10 for providing, e.g., domestic alternating current (AC) of 220-240 volts or the like. The power socket 10 includes a shell (not labeled) and a pop-up mechanism 30. The shell includes a top cover 120 and a bottom cover 110 engaged with each other to define a first accommodating space 130 to receive the pop-up mechanism 30. The pop-up mechanism 30 is capable of generating a magnetic force having a first magnetic field direction and attracting the power plug 20 in place in the power socket 10, and generating a magnetic force having a second magnetic field direction opposite to the first magnetic field direction and repelling the power plug 20 out of the power socket 10.

The power plug 20 can be for example a three-pin plug or a two-pin plug. In this embodiment, the power plug 20 is a two-pin plug. The power plug 20 includes a main part 220 and a magnet 230. Two plug pins 210 perpendicularly extend from a surface 221 of the main part 220, and the power plug 20 receives operation voltages from the power socket 10 by insertion of the two plug pins 210 into the power socket 10. The magnet 230 is received in the main part 220.

Figure 2:
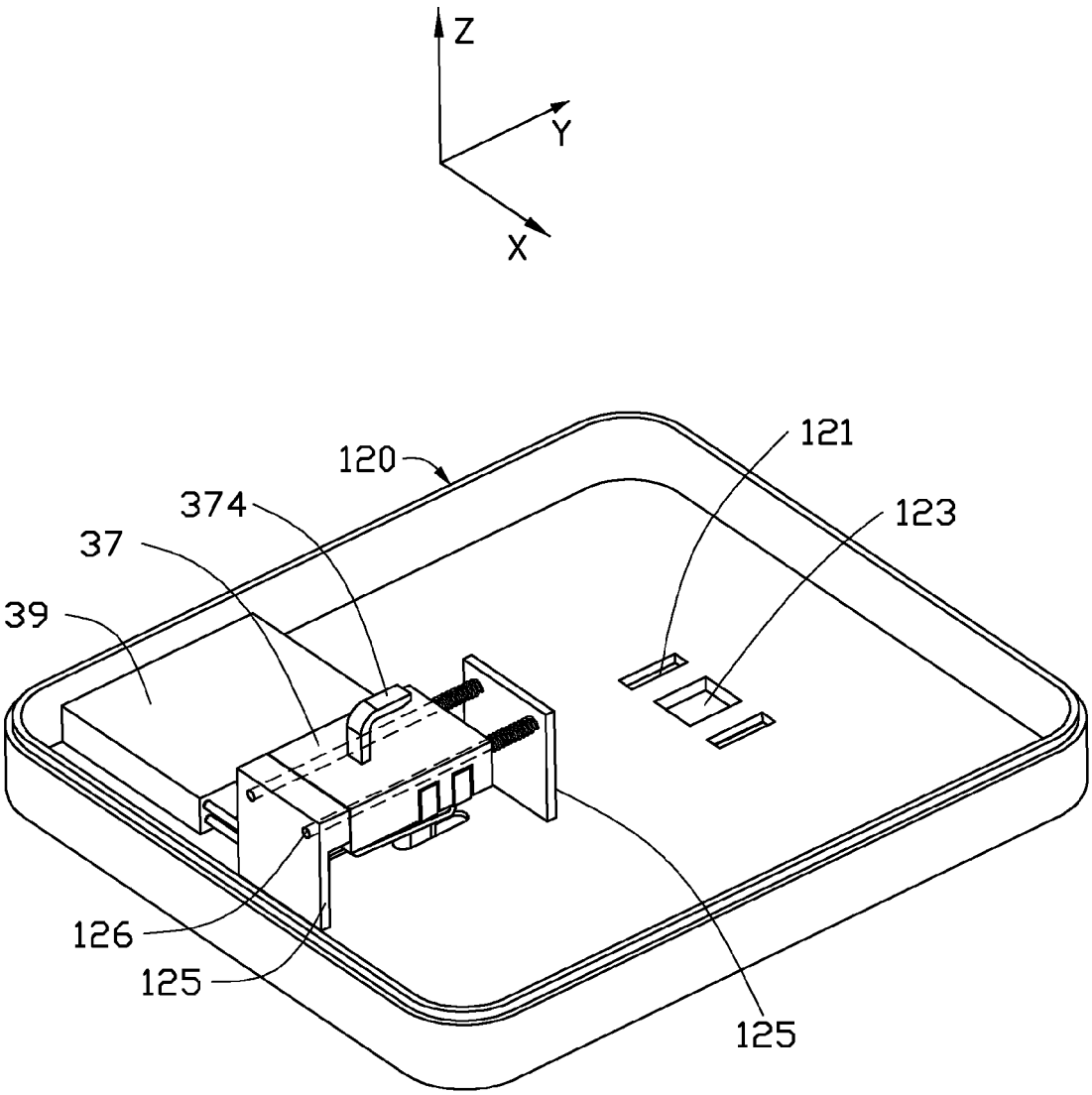
FIG. 2 is an isometric view of the top cover with the battery and the sliding assembly fixed to the top cover of FIG. 1.

Referring also to FIG. 2, the top cover 120 defines an opening 123, two insertion holes 121, and an operation slot 122. The two insertion holes 121 are located at opposite sides of the opening 123 for receiving the two plug pins 210. The operation slot 122 aligns with the opening 123 along a first direction, and the insertion holes 121 align with the opening 123 along a second direction. In the embodiment, the first direction is a direction parallel to an X-axis as shown in FIG. 1, and the second direction is a direction parallel to a Y-axis as shown in FIG. 1. Two first supporting plates 125 perpendicularly extend from an inner surface of the top cover 120 towards the bottom cover 110. The first supporting plates 125 are located at opposite sides of the operation slot 122, one of the first supporting plates 125 is adjacent to the opening 123, and the other one of the first supporting plates 125 is away from the opening 123. The first supporting plates 125 are configured to support two sliding bars 126. Two ends of each sliding bar 126 are respectively fixed in the two first supporting plates 125, thereby defining two sliding tracks parallel to the first direction.

The bottom cover 110 includes a rectangular bottom plate 111, four sidewalls 112, two second supporting plates 114, and a fixing pillar 116. The sidewalls 112 extend from an edge of the bottom plate 111 to the top cover 120 and form the first accommodating space 130. The fixing pillar 116 is hollow and is arranged at the bottom plate 111 corresponding to the opening 123 of the top cover 120. The second supporting plates 114 are arranged parallel to each other and perpendicularly extend from an inner surface of the bottom plate 111 towards the top cover 120. The second supporting plates 114 are located corresponding to a location between the operation slot 122 and a virtual line defined by the insertion holes 121 and the opening 123.

The pop-up mechanism 30 includes an electromagnet 31, a pushing pillar assembly 35, two conductive blades 33, a sway bar assembly 36, a sliding assembly 37, and a battery 39. The battery 39 is configured to provide power to the electromagnet 31 via the sliding assembly 37 and the conductive blades 33, and includes a pair of electrodes 391. One of the electrodes 391 is a positive electrode 391*a*, and the other one of the electrodes 391 is a negative electrode 391*b*.

The electromagnet 31 defines a through hole 312, and includes a first pin 311*a* and a second pin 311*b*. When a first current flows from the first pin 311*a* to the second pin 311*b*, the first magnetic field is generated with the first magnetic field oriented such that the magnet 230 and the electromagnet 31 attract each other. When a second current flows from the second pin 311*b* to the first pin 311*a*, the second magnetic field is generated such that the magnet 230 and the electromagnet 31 repel each other.

The pushing pillar assembly 35 is configured to move up and down along a third direction parallel to a Z-axis as shown in FIG. 1. The pushing pillar assembly 35 includes a pushing pillar 353 and a first elastic member 356. The pushing pillar 353 includes a base body 3530, an inserting rod 3532, and an abutting arm 3531. The base body 3530 includes a bottom wall facing the bottom plate 111 and a sidewall perpendicularly connected to the bottom wall. The inserting rod 3532 is connected to the bottom wall of the base body 3530, and the abutting arm 3531 extends from the side wall of the base body 3530 towards the sway bar assembly 36. The inserting rod 3532 includes a first rod portion 3533 and a second rod portion 3534 both extending along the third direction. The first rod portion 3533 interconnects the base body 3530 and the second rod portion 3534. A cross-sectional area of the first rod portion 3533 is greater than that of the second rod portion 3534, thereby defining a stepped-structure. The abutting arm 3531 has a protrusion downwardly extending towards the sway bar assembly 36. The first elastic member 356 sleeves on the second rod portion 3534, with an end of the first elastic member 356 abutting against the first rod portion 3533.

The sway bar assembly 36 includes a sway bar 361, a spindle 362, and a torsion spring 363. The spindle 362 extends along the second direction and is fixed between the two second supporting plates 114 of the bottom cover 110. The sway bar 361 is capable of rotating around the spindle 362 like a seesaw, and includes a seesaw plate 3611 and a fixing rod 3612. The fixing rod 3612 extends from one end of the seesaw plate 3611 along the second direction, and the seesaw plate 3611 is arranged perpendicular to the fixing rod 3612. Another end of the seesaw plate 3611 reaches a position just below the abutting arm 3531, to make the other end of the seesaw plate 3611 capable of contacting the protrusion of the abutting arm 3531 when the other end is raised to a high position. The torsion spring 363 sleeves on the spindle 362 and provides a resilient force to the sway bar 361 when the sway bar 361 rotates.

Two conductive blades 33 are respectively attached to opposite ends of the fixing rod 3612 of the sway bar 361. Each conductive blade 33 includes a first end 331 and a second end 332 opposite to the first end 331. A conductive pad 3320 is attached to each second end 332 of the conductive blades 33. The first ends 331 of the conductive blades 33 are respectively connected to the first pin 311*a* and second pin 311*b* of the electromagnet 31 via conductive members 38, by means such as wires or electro-conductive sheets.

Figure 3:
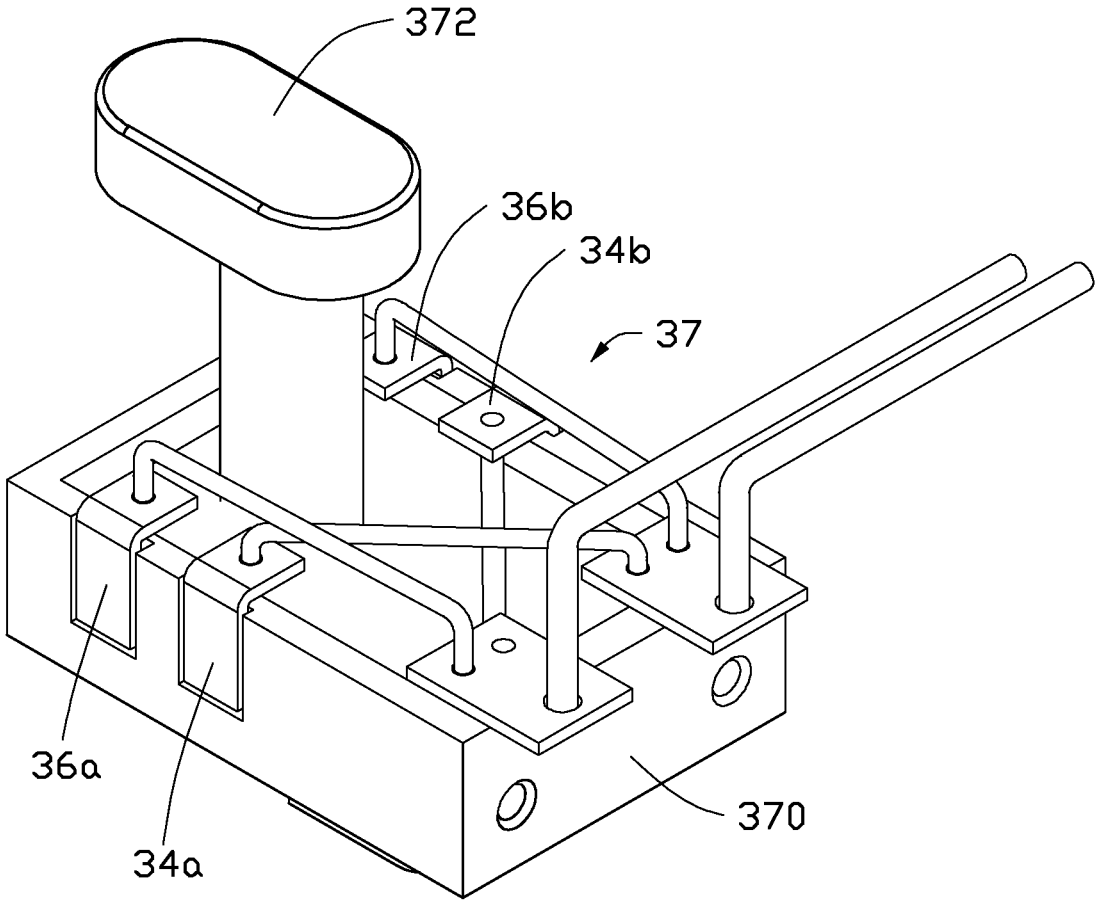
FIG. 3 is an isometric view of the sliding assembly of FIG. 1.

Referring also to FIG. 3, the sliding assembly 37 includes a main body 370, a pushing button 372, a buckling portion 374, two second elastic members 375, a pair of first conductive pins 34, and a pair of second conductive pins 36. The pushing button 372 extends from a top surface of the main body 370 towards the top cover 120, with a head of the pushing button 372 extending out of the top cover 120 via the operation slot 122 of the top cover 120. The buckling portion 374 extends from a bottom surface opposite to the top surface of the main body 370. The buckling portion 374 includes a first portion perpendicularly extending from the bottom surface and a second portion parallel to the bottom surface. The first portion of the buckling portion 374 interconnects the second portion of the buckling portion 374 and the main body 370, and an opening of the buckling portion 374 faces the fixing rod 3612 of the sway bar 361. The main body 370 of the sliding assembly 37 sleeves on the sliding bars 126, and is capable of moving back and forth along the first direction. The first conductive pins 34 are located at opposite lateral sidewalls of the main body 370. One of the first conductive pin 34*a* connects to the negative electrode 391*b* of the battery 39, and the other first conductive pin 34*b* connects to the positive electrode 391*a* of the battery 39. The second conductive pins 36 are located at the opposite lateral sidewalls of the main body 370. One of the second conductive pin 36*a* connects to the positive electrode 391*a* of the battery 39, and the other second conductive pin 36*b* connects to the negative electrode 391*b* of the battery 39. The first conductive pin 34*a* and the second conductive pin 36*a* are located at a same lateral sidewall of the main body 370, and the first and second conductive pin 34*b*, 36*b* are located at a same lateral sidewall of the main body 370. In the embodiment, the second conductive pins 36*a*, 36*b* are adjacent to the opening 123 of the top cover 120, and the first conductive pins 34*a*, 34*b* are away from the opening 123.

Figure 4:
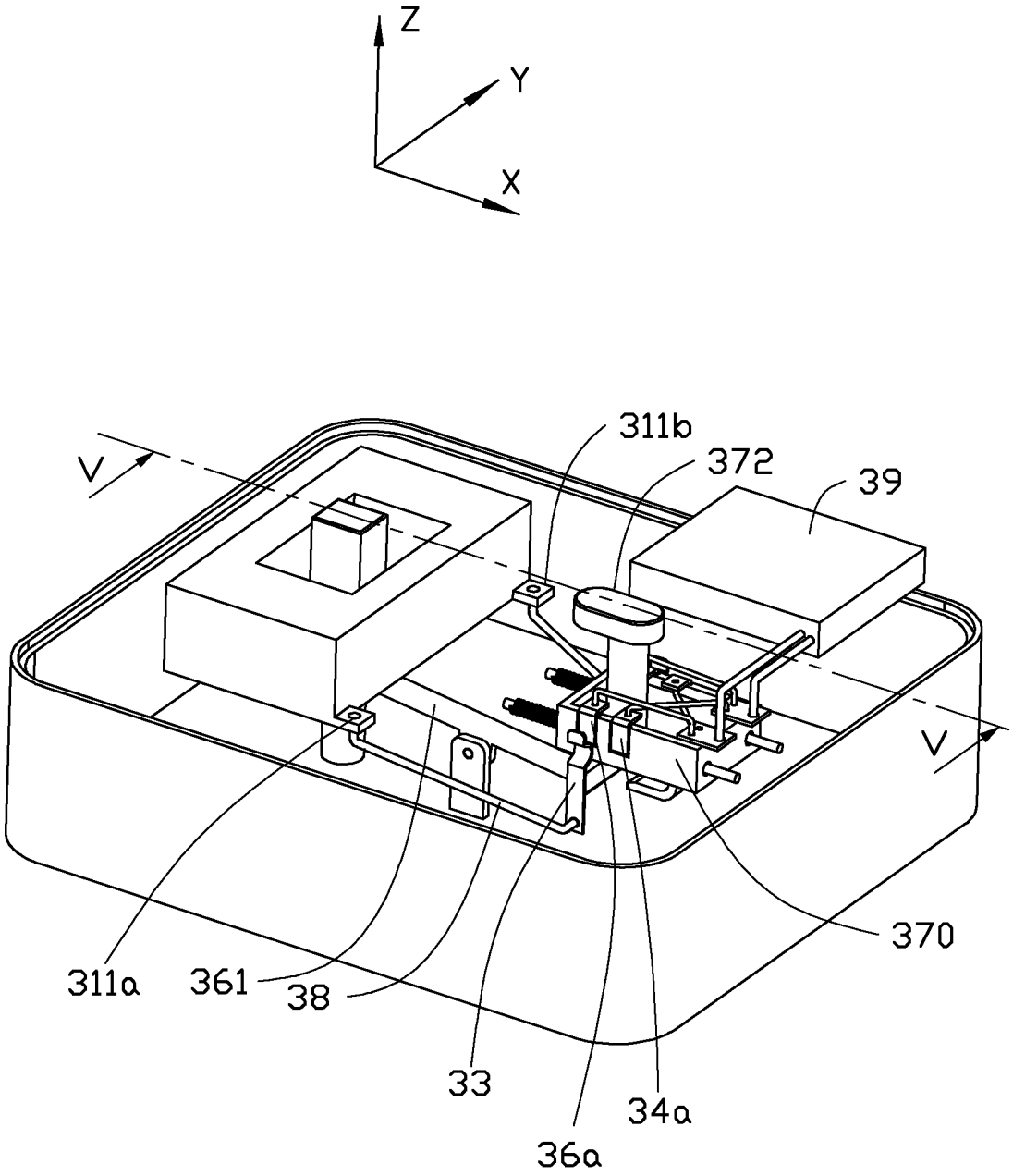
FIG. 4 is an assembled view of the electrical connector assembly of FIG. 1, but omitting the power plug and the top cover of the electrical connector assembly, and showing a floating mode of the electrical connector assembly.
Figure 5:
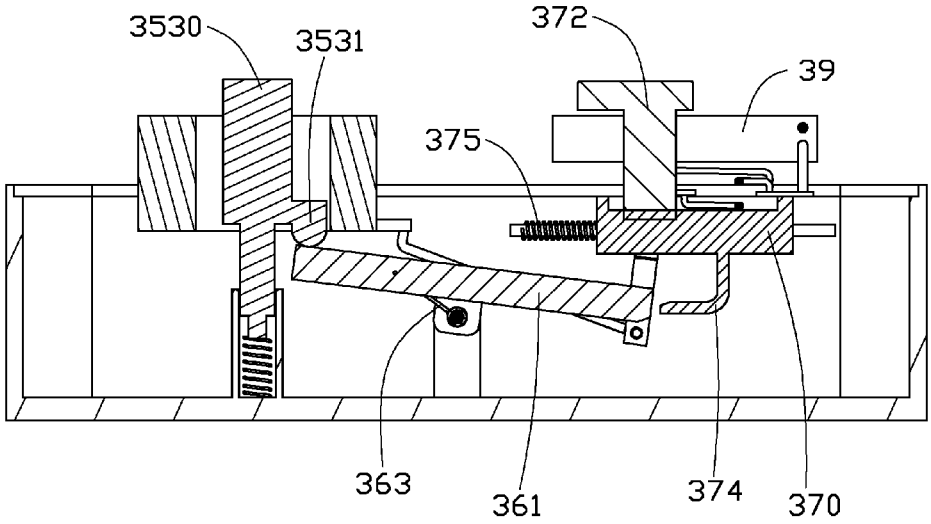
FIG. 5 is a cross-sectional view of the electrical connector assembly of FIG. 4, corresponding to line V-V thereof.

Referring also to FIGS. 4-5, in assembly of the power socket 10, the first elastic member 356 sleeves on the second rod portion 3534, the inserting rod 3532 with the second rod portion 3534 surrounded by the first elastic member 356 is inserted into the hollow fixing pillar 116 of the bottom cover 110. The first elastic member 356 is sandwiched between an inner bottom surface of the hollow fixing pillar 116 and the first rod portion 3533 of the inserting rod 3532. The electromagnet 31 is fixed in the first accommodating space 130, with the base body 3530 of the pushing pillar 353 received in the through hole 312 of the electromagnet 31. The pushing pillar 353 is movable up and down along the third direction relative to the bottom plate 111 of the bottom cover 110, and the first elastic member 356 exerts resilient force when the pushing pillar 353 moves up and down along the third direction. The spindle 362 is fixed between the two second supporting plates 114 of the bottom cover 110. The seesaw plate 3611 is rotatably attached to the spindle 362. The torsion spring 363 sleeves on the spindle 362 and provides a resilient force to the seesaw plate 3611 when the seesaw plate 3611 rotates. Initially, the end of the seesaw plate 3611 far away from the fixing rod 3612 is in the high position under an action of the torsion spring 363 and abuts against the protrusion of the abutting arm 3531, and the other end of the seesaw plate 3611 adjacent to the fixing rod 3612 is in a low position below the main body 370. Two conductive blades 33 are respectively attached to opposite ends of the fixing rod 3612 of the sway bar 361. The first ends 331 of the conductive blades 33 are respectively connected to the first pin 311*a* and second pin 311*b* of the electromagnet 31 via the conductive members 38.

Referring back to FIG. 2, the second elastic members 375 sleeve on the sliding bars 126 respectively, the main body 370 sleeves on the sliding bars 126, and the head of the pushing button 372 extends out of the top cover 120 via the operation slot 122. The second elastic members 375 are sandwiched between the first supporting plate 125 adjacent to the opening 123 and the main body 370. The main body 370 is capable of moving back and forth along the sliding bars 126 when the pushing button 372 is pushed to move back and forth in the operation slot 122. The second elastic members 375 exert resilient force when the main body 370 moves back and forth along the sliding bars 126.

Then, the top cover 120 is engaged with the bottom cover 110, the top end of the base body 3530 of the pushing pillar 353 extends out of the top cover 120 via the opening 123, and the head of the pushing button 372 extends out of the top cover 120 via the operation slot 122. Initially, before the power plug 20 is inserted into the power socket 10, the conductive pads 3320 are arranged adjacent to the second conductive pins 36*a*, 36*b*, and are separated from the second conductive pins 36*a*, 36*b* thereby being in a floating connection state. At this time, no current is applied to the electromagnet 31.

Figure 6:
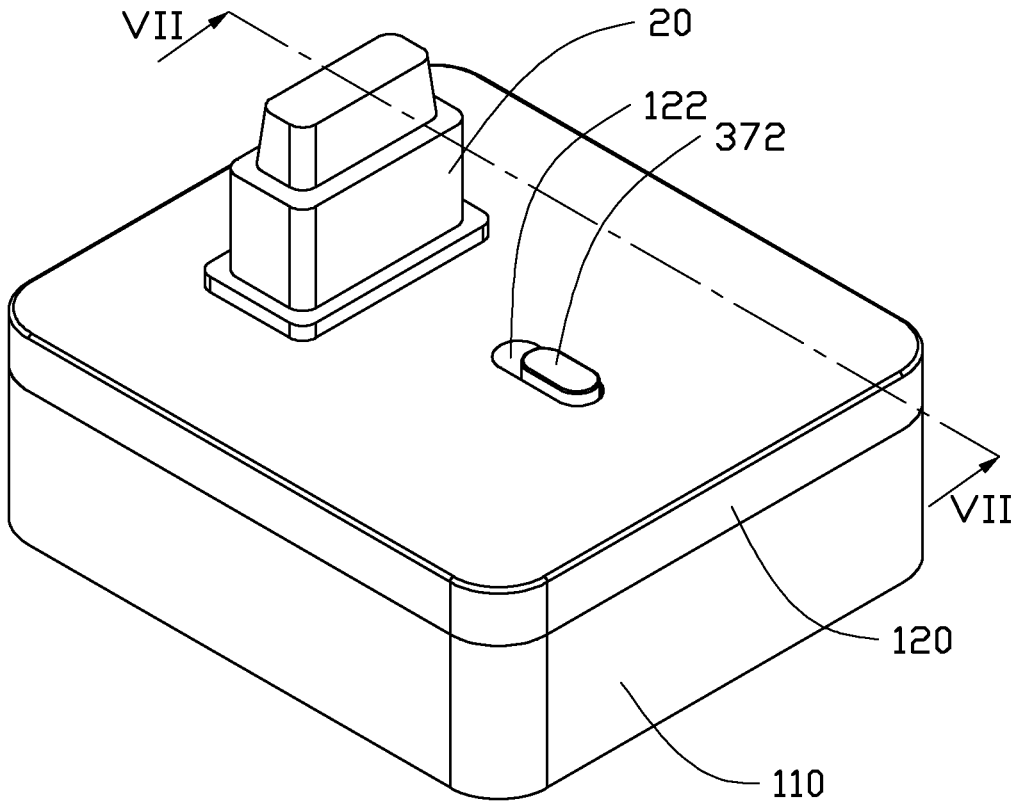
FIG. 6 is an assembled view of the electrical connector assembly of FIG. 1.
Figure 7:
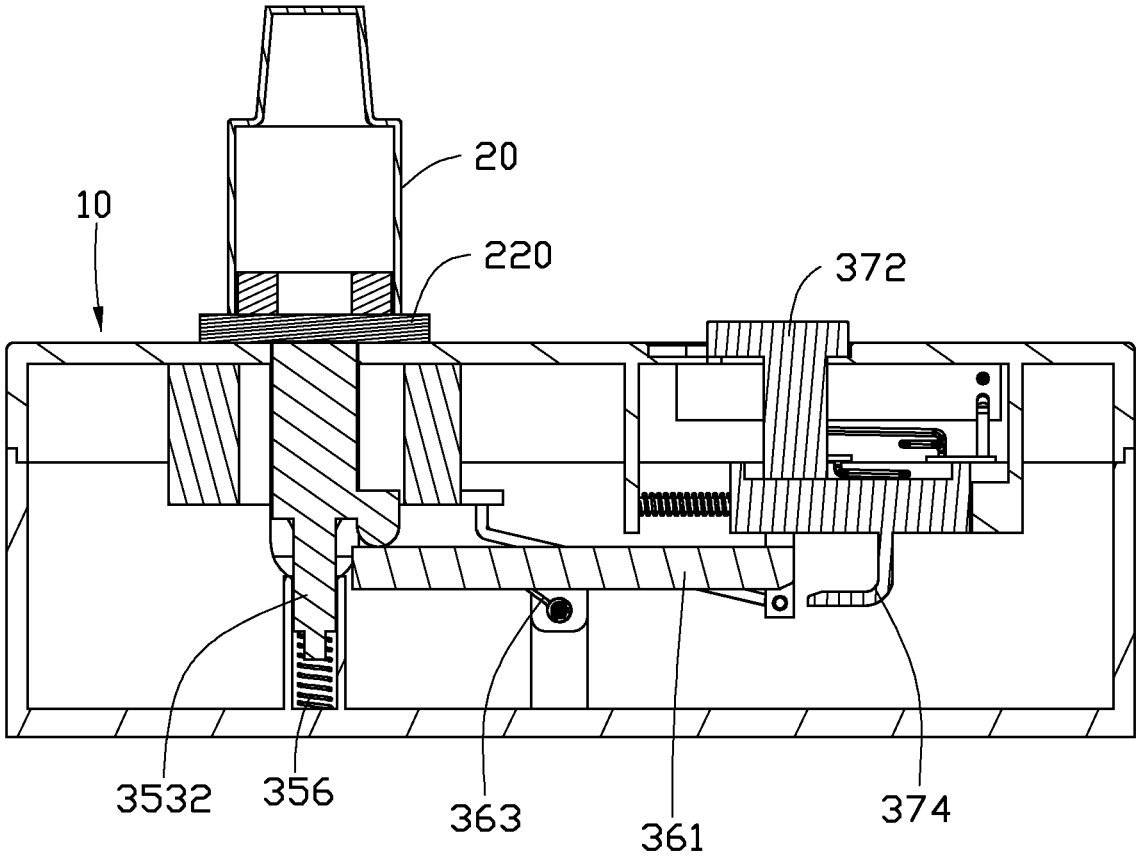
FIG. 7 is a cross-sectional view of the electrical connector assembly of FIG. 6, corresponding to line VII-VII thereof.
Figure 8:
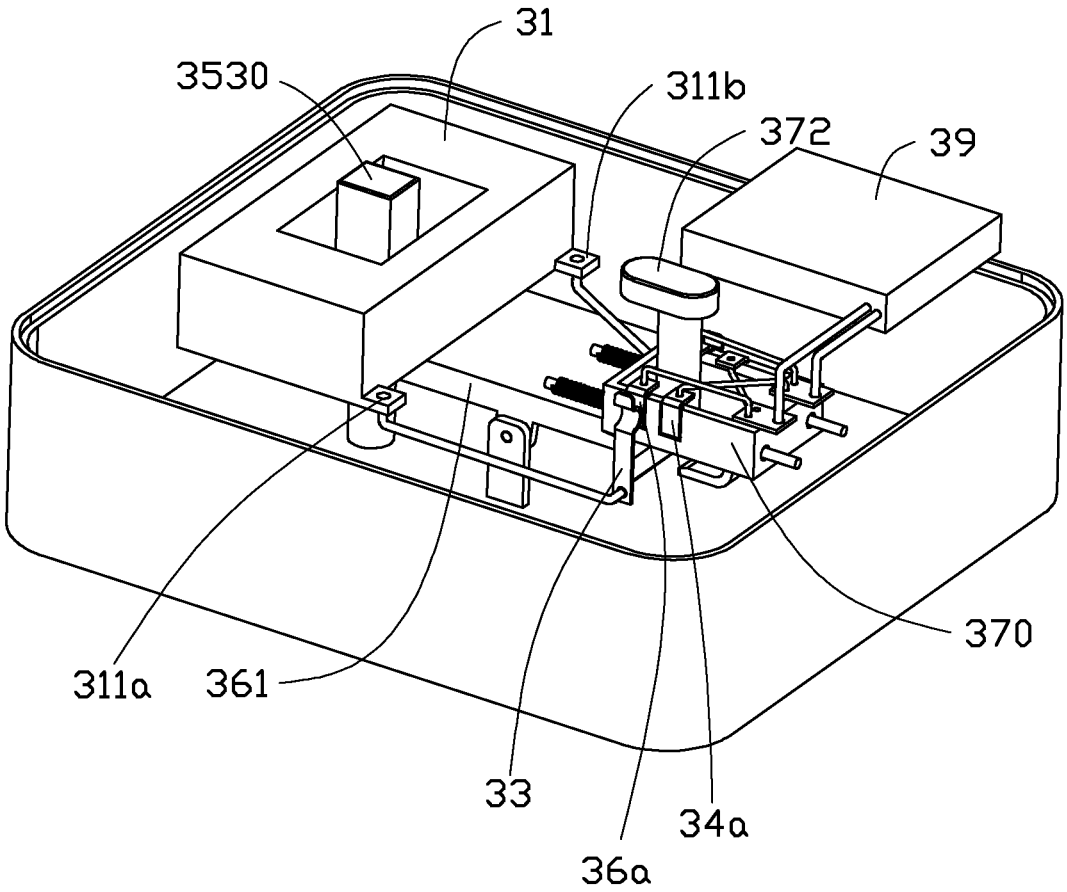
FIG. 8 is similar to FIG. 6, but showing a first connection mode of the electrical connector assembly.

Referring also to FIG. 6-8, when the power plug 20 of the electronic device is inserted into the power socket 10, the plug pins 210 of the power plug 20 are inserted into the insertion holes 121 to receive operation voltage provided by the power socket 10. The surface 221 of the main part 220 pushes the base body 3530 of the pushing pillar 353 to move down towards the bottom cover 110. The abutting arm 3531 moves in unison with the pushing pillar 353 and causes the sway bar 361 to rotate counterclockwise relative to the spindle 362. The conductive blades 33 rotate in unison with the sway bar 361, and drive the conductive pad 3320 of the conductive blade 33, which is connected to the first pin 311*a* of the electromagnet 31, to connect to the second conductive pin 36*a*, and the conductive pad 3320 of the conductive blade 33, which is connected to the second pin 311*b* of the electromagnet 31, to connect to the second conductive pin 36*b*. Because the second conductive pin 36*a* is connected to the positive electrode 391*a* of the battery 39, and the second conductive pin 36*b* is connected to the negative electrode 391*b* of the battery 39, the electromagnet 31 receives the first current, and the first current flows from the first pin 311*a* to the second pin 311*b*, thereby generating the first magnetic field. At this time, the magnet 230 and the electromagnet 31 attract each other. The power plug 20 is more firmly held in the power socket 10.

Figure 9:
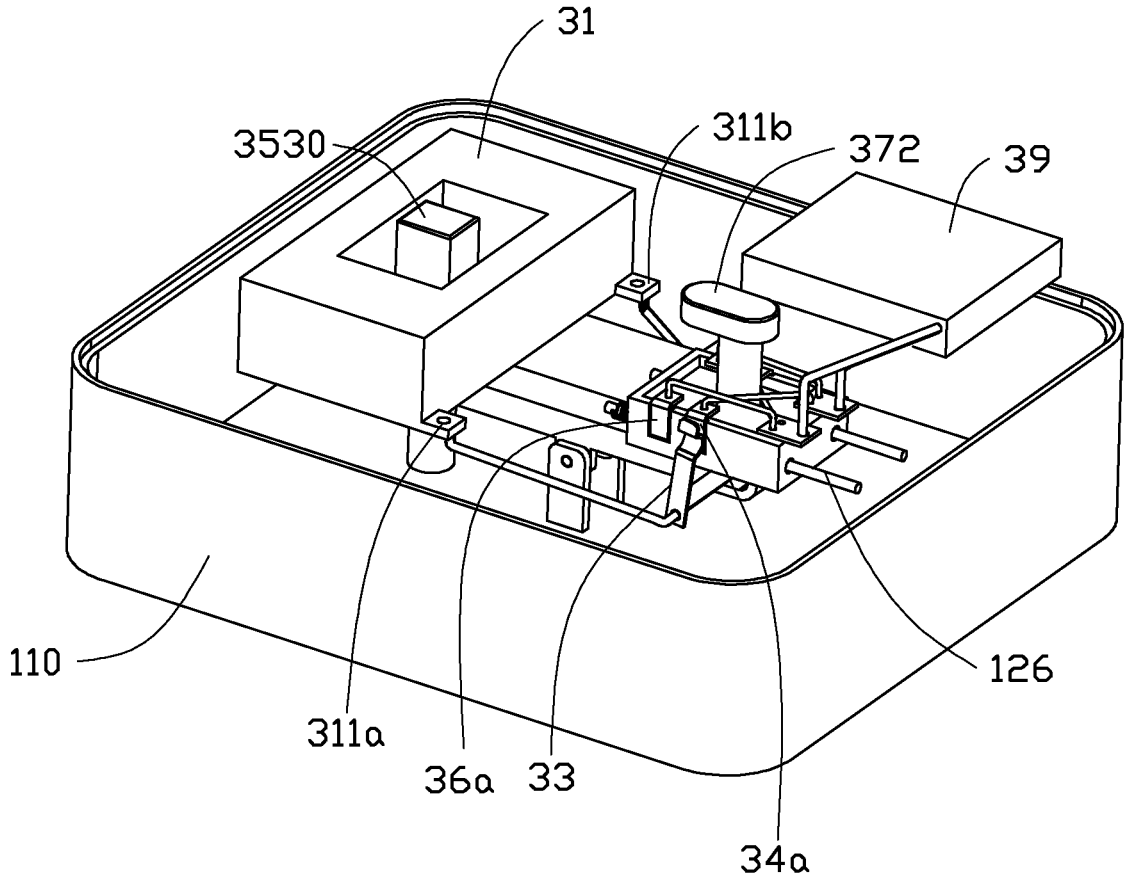
FIG. 9 is similar to FIG. 8, but showing a second connection mode of the electrical connector assembly.

Referring to FIG. 9, when the head of the pushing button 372 is pushed towards the power plug 20, the main body 370 moves in unison with the pushing button 372 towards the power plug 20. The buckling member 374 moves in unison with the pushing button 372 and is buckled with the sway bar 361 to prevent the sway bar 361 from rotating. The second conductive pins 36 exit and are separated from the conductive pads 3320 of the conductive blades 33, and the first conductive pins 34 are connected to the conductive pads 3320 of the conductive blades 33. At which time, the first conductive pin 34*a* connects to the first pin 311*a* of the electromagnet 31, and the first conductive pin 34*b* connects to the second pin 311*b* of the electromagnet 31. Because the first conductive pin 34*a* is connected to the negative electrode 391*b* of the battery 39, and the first conductive pin 34*b* is connected to the positive electrode 391*a*, the electromagnet 31 receives the second current, and the second current flows from the second pin 311*b* to the first pin 311*a*, thereby generating the second magnetic field, and the magnet 230 and the electromagnet 31 repel each other. The power plug 20 is repelled out and away from the power socket 10 and thus is easily separated from the power socket 10.

After the power plug is unplugged from the power socket 10, the first elastic member 356 exerts resilient force to drive the pushing pillar 353 to move up towards the top cover 120, and the top end of the base body 3530 of the pushing pillar 353 extends out of the top cover 120 via the opening 123, and the protrusion of the abutting arm separates from the seesaw plate 3611. Because the external force on the pushing button is not released, the sway bar 361 remains in place by virtue of the buckling portion 374 being bucked with the sway bar 361.

Referring back to FIG. 5, when the pushing button 372 is released, the second elastic members 375 exert resilient force to drive the main body 370 to move back along the sliding bar 126 away from the opening 123 of the top cover 120. The buckling member 374 disengages from the fixing rod 3612 of the sway bar 361 to release the sway bar 361. The torsion spring 363 exerts resilient force to drive the sway bar 361 to rotate clockwise, thereby returning the power socket 10 to the initial state, and the conductive pads 3320 of the conductive blades 33 are in the floating connection state again. At which time, no current is applied to the electromagnet 31.

With the above-described configuration, the power plug 20 can easily and conveniently unplugged from the power socket 10 only by merely pushing the pushing button 372.

The power socket herein is not limited to the above-described embodiments. For example, in alternative embodiments, the power socket 10 may omit the pushing pillar assembly 35, the sway bar assembly 37, and the pair of the second conductive pins 36. The two conductive blades 33 are fixed in the first accommodating space 130, and are located beside the pair of the first conductive pins 34. When the user pushes the pushing button 372 towards the power plug 20, the conductive pads 3320 of the conductive blades 33 contact the first conductive pins 34, and accordingly the electromagnet 31 receives the second current and generates the second magnetic field. Therefore, the power plug 20 is repelled from the power socket 10, and the power plug 20 is unplugged from the power socket 10.

It is believed that the present embodiments and their advantages will be understood from the foregoing description, and it will be apparent that various changes may be made thereto without departing from the spirit and scope of the description or sacrificing all of their material advantages, the examples hereinbefore described merely being exemplary embodiments.

What is claimed is:

1. An electrical connector assembly, comprising:

a power plug being capable of generating a magnetic force; and a power socket allowing the power plug to be insertably connected for providing power to the power plug, the power socket comprising a shell and a pop-up mechanism, the shell defining a first accommodating space to receive the pop-up mechanism, the pop-up mechanism comprising:

a sliding assembly capable of moving back and forth along a first direction under control of an external force applied to the sliding assembly, and changing locations of the sliding assembly between a first position and a second position, the sliding assembly comprising a main body moving together with the sliding assembly, a battery, and a pair of first conductive pins located at the main body and connected to electrodes of the battery, an electromagnet comprising a first pin and a second pin; and two conductive blades being received in the first accommodating space, one of the conductive blades connected to the first pin of the electromagnet, and the other one of the conductive blades connected to the second pin of the electromagnet;

wherein the two conductive blades contact with the pair of first conductive pins until the sliding assembly moves to the second position from the first position by an external force, the electromagnet receives a first current provided by the battery via the pair of the first conductive pins and the two conductive blades, the first current flows from the second pin to the first pin, and the electromagnet generates a magnetic field with the magnetic field oriented such that the power plug and the power socket repel each other.

2. The electrical connector assembly of claim 1, wherein the sliding assembly further comprises a pair of second conductive pins located at the main body and connected to electrodes of the battery, the pop-up mechanism further comprises a mechanical drive module, and the conductive blades are attached to the mechanical drive module, when the power plug is unplugged into the power socket and the sliding assembly is located at the first position, the conductive blades are floating, and are separated from the first and second conductive pins of the main body, when the power plug is plugged into the power socket and the sliding assembly located at the first position, the mechanical drive module is driven to cause the conductive blades to connect with the second conductive pins, the electromagnet receives a second current provided by the battery via the pair of the second conductive pins and the two conductive blades, a direction of the second current is opposite to a direction of the first current, the second current flows from the first pin to the second pin, and the electromagnet generates another magnetic field with the another magnetic field oriented such that the power plug and the power socket attract each other.

3. The electrical connector assembly of claim 2, wherein the mechanical drive module comprises a sway bar assembly and a pushing pillar assembly, the sway bar assembly comprises a sway bar and a spindle extending along a second direction perpendicular to the first direction, the sway bar is capable of rotating around the spindle like a seesaw, the conductive blades attach to the sway bar at opposite sides of the sway bar, the pushing pillar assembly is configured to move up and down along a third direction perpendicular to the first and second direction, an end of the sway bar is located below an abutting arm of the pillar assembly, and the abutting arm abuts against the end of the sway bar when the conductive blades are floating, when the power plug is being plugged into the power socket, the pushing pillar assembly is driven to move down, the abutting arm moves down in unison with the pushing pillar assembly and cause the sway bar to rotate counterclockwise, the conductive blades rotate in unison with the sway bar and connect to the second conductive pins.

4. The electrical connector assembly of claim 3, wherein the pillar assembly further comprises a pushing pillar and a first elastic member, the pushing pillar includes a base body and an inserting rod, the inserting rod is connected to a bottom wall of the pushing pillar, the inserting rod comprises a first rod portion and a second rod portion, the first rod portion interconnects the second rod portion and the base body, the first elastic member sleeves on the second rod portion and exerts a resilient force when the pushing pillar moves up and down along the third direction, the abutting arm connects to a side wall of the pushing pillar perpendicular to the bottom wall of the pushing pillar.

5. The electrical connector assembly of claim 4, wherein the sway bar assembly further comprises a torsion spring, the torsion spring sleeves on the spindle and exerts a resilient force to the sway bar when the sway bar rotates, the sway bar comprises a seesaw plate and a fixing rod, the fixing rod extends along the second direction, the seesaw plate is perpendicular to the fixing rod, an end of the seesaw plate far away from the fixing rod of the sway bar abuts against the abutting arm when the conductive blades are floating, the other end of the seesaw plate connects to the fixing rod of the sway bar, the fixing rod of the sway bar are located below the main body of sliding assembly, and the conductive blades attached to opposite ends of the fixing rod of the sway bar.

6. The electrical connector assembly of claim 5, wherein the shell comprises a top cover and a bottom cover, the top cover defines an opening for allowing a top end of the pushing pillar to extend out, two insertion holes for the insertion of the power plug, and an operation slot, the sliding assembly further comprises a pushing button extending from a top surface of the main body, and a head of the pushing button extends out of the top cover via the operation slot, the operation slot aligns with the opening along the first direction, the insertion holes are located at opposite sides of the opening, and align with the opening along the second direction, two first supporting plates perpendicularly extend from an inner surface of the top cover, and are located at opposite sides of the operation slot, the first supporting plates are configured to support at least one sliding bar extending along the first direction, the main body of the sliding assembly sleeves on the at least one sliding bar, and is configured to move back and forth along the at least one sliding bar, the sliding assembly further comprises at least one second elastic member, the at least one second elastic member sleeves on the at least one sliding bar and is switched between the main body and a first supporting plate adjacent to the opening, the at least one second elastic member exerts a resilient force to the main body when the main body moves back and forth along the first direction.

7. The electrical connector assembly of claim 6, wherein the bottom cover comprises a fixing pillar and two second supporting plates perpendicular to the second direction, the fixing pillar is hollow and correspond to the inserting rod of the pushing pillar, the inserting rod with the second rod portion surrounded by the first elastic member is inserted into the hollow fixing pillar, a cross-sectional area of the first rod portion is greater than that of the second rod portion, the first elastic member is sandwiched between an inner bottom surface of the hollow fixing pillar and the first rod portion of the inserting rod, and the spindle is fixed between the second supporting plates.

8. The electrical connector assembly of claim 7, wherein the electromagnet defines a through hole to receive the base body of the pushing pillar, and the base body extend out of the through hole, with the top end of the base body extending out of the top cover.

9. The electrical connector assembly of claim 5, wherein each of the conductive blades comprises a first end and a second end opposite to the first end, the second end attached with a contact pad, the first ends of the conductive blades connect to the first pins and the second pins via conductive members, and the conductive blades connect to the first and second conductive pins via the conductive pads.

10. The electrical connector assembly of claim 2, wherein one of the first conductive pins connects to a positive electrode of the battery, the other one of the first conductive pins connects to a negative electrode of the battery, the first conductive pins are located at opposite lateral sidewalls of the main body of the sliding assembly, one of the second conductive pins connects to the positive electrode of the battery, the other one of the second conductive pins connects to the negative electrode of the battery, the second conductive pins are located at opposite lateral sidewalls of the main body of the sliding assembly, the first conductive pin connected to the positive electrode of the battery and the second conductive pin connected to negative electrode of the battery are located at a same lateral sidewall of the main body, first conductive pin connected to the negative electrode of the battery and the second conductive pin connected to the positive electrode of the battery are located at another same lateral sidewall of the main body, the second conductive pins are adjacent to the insertion hole, and the first conductive pins are away from the insertion hole.

11. A power socket comprising:

a shell defining a first accommodating space; and a pop-up mechanism being received in the first accommodating space, the pop-up mechanism comprising:

a sliding assembly capable of moving back and forth along a first direction under control of an external force applied to the sliding assembly, and changing locations of the sliding assembly between a first position and a second position, the sliding assembly comprising a main body moving together with the sliding assembly, a battery, and a pair of first conductive pins located at the main body and connected to electrodes of the battery, an electromagnet comprising a first pin and a second pin; and two conductive blades being received in the first accommodating space, one of the conductive blades connected to the first pin of the electromagnet, and the other one of the conductive blades connected to the second pin of the electromagnet;

wherein the two conductive blades contact with the pair of first conductive pins until the sliding assembly moves to the second position from the first position by an external force, the electromagnet receives a first current provided by the battery via the pair of the first conductive pins and the two conductive blades, the first current flows from the second pin to the first pin, and the electromagnet generates a magnetic field with the magnetic field oriented such that the power socket and a power plug having a magnetic force repel each other.

12. The power socket of claim 11, wherein the sliding assembly further comprises a pair of second conductive pins located at the main body and connected to electrodes of the battery, the pop-up mechanism further comprises a mechanical drive module, and the conductive blades are attached to the mechanical drive module, when the power plug is unplugged into the power socket and the sliding assembly is located at the first position, the conductive blades are floating, and are separated from the first and second conductive pins of the main body, when the power plug is plugged into the power socket and the sliding assembly located at the first position, the mechanical drive module is driven to cause the conductive blades to connect with the second conductive pins, the electromagnet receives a second current provided by the battery via the pair of the second conductive pins and the two conductive blades, a direction of the second current is opposite to a direction of the first current, the second current flows from the first pin to the second pin, and the electromagnet generates another magnetic field with the another magnetic field oriented such that the power plug and the power socket attract each other.

13. The power socket of claim 12, wherein the mechanical drive module comprises a sway bar assembly and a pushing pillar assembly, the sway bar assembly comprises a sway bar and a spindle extending along a second direction perpendicular to the first direction, the sway bar is capable of rotating around the spindle like a seesaw, the conductive blades attach to the sway bar at opposite sides of the sway bar, the pushing pillar assembly is configured to move up and down along a third direction perpendicular to the first and second direction, an end of the sway bar is located below an abutting arm of the pillar assembly, and the abutting arm abuts against the end of the sway bar when the conductive blades are floating, when the power plug is being plugged into the power socket, the pushing pillar assembly is driven to move down, the abutting arm moves down in unison with the pushing pillar assembly and cause the sway bar to rotate counterclockwise, the conductive blades rotate in unison with the sway bar and connect to the second conductive pins.

14. The power socket of claim 13, wherein the pillar assembly further comprises a pushing pillar and a first elastic member, the pushing pillar includes a base body and an inserting rod, the inserting rod is connected to a bottom wall of the pushing pillar, the inserting rod comprises a first rod portion and a second rod portion, the first rod portion interconnects the second rod portion and the base body, the first elastic member sleeves on the second rod portion and exerts a resilient force when the pushing pillar moves up and down along the third direction, the abutting arm connects to a side wall of the pushing pillar perpendicular to the bottom wall of the pushing pillar.

15. The power socket of claim 14, wherein the sway bar assembly further comprises a torsion spring, the torsion spring sleeves on the spindle and exerts a resilient force to the sway bar when the sway bar rotates, the sway bar comprises a seesaw plate and a fixing rod, the fixing rod extends along the second direction, the seesaw plate is perpendicular to the fixing rod, an end of the seesaw plate far away from the fixing rod of the sway bar abuts against the abutting arm when the conductive blades are floating, the other end of the seesaw plate connects to the fixing rod of the sway bar, the fixing rod of the sway bar are located below the main body of sliding assembly, and the conductive blades attached to opposite ends of the fixing rod of the sway bar.

16. The power socket of claim 15, wherein the shell comprises a top cover and a bottom cover, the top cover defines an opening for allowing a top end of the pushing pillar to extend out, two insertion holes for the insertion of the power plug, and an operation slot, the sliding assembly further comprises a pushing button extending from a top surface of the main body, and a head of the pushing button extends out of the top cover via the operation slot, the operation slot aligns with the opening along the first direction, the insertion holes are located at opposite sides of the opening, and align with the opening along the second direction, two first supporting plates perpendicularly extend from an inner surface of the top cover, and are located at opposite sides of the operation slot, the first supporting plates are configured to support at least one sliding bar extending along the first direction, the main body of the sliding assembly sleeves on the at least one sliding bar, and is configured to move back and forth along the at least one sliding bar, the sliding assembly further comprises at least one second elastic member, the at least one second elastic member sleeves on the at least one sliding bar and is switched between the main body and a first supporting plate adjacent to the opening, the at least one second elastic member exerts a resilient force to the main body when the main body moves back and forth along the first direction.

17. The power socket of claim 16, wherein the bottom cover comprises a fixing pillar and two second supporting plates perpendicular to the second direction, the fixing pillar is hollow and correspond to the inserting rod of the pushing pillar, the inserting rod with the second rod portion surrounded by the first elastic member is inserted into the hollow fixing pillar, a cross-sectional area of the first rod portion is greater than that of the second rod portion, the first elastic member is sandwiched between an inner bottom surface of the hollow fixing pillar and the first rod portion of the inserting rod, and the spindle is fixed between the second supporting plates.

18. The power socket of claim 17, wherein the electromagnet defines a through hole to receive the base body of the pushing pillar, and the base body extend out of the through hole, with the top end of the base body extending out of the top cover.

19. The power socket of claim 15, wherein each of the conductive blades comprises a first end and a second end opposite to the first end, the second end attached with a contact pad, the first ends of the conductive blades connect to the first pins and the second pins via conductive members, and the conductive blades connect to the first and second conductive pins via the conductive pads.

20. The power socket of claim 12, wherein one of the first conductive pins connects to a positive electrode of the battery, the other one of the first conductive pins connects to a negative electrode of the battery, the first conductive pins are located at opposite lateral sidewalls of the main body of the sliding assembly, one of the second conductive pins connects to the positive electrode of the battery, the other one of the second conductive pins connects to the negative electrode of the battery, the second conductive pins are located at opposite lateral sidewalls of the main body of the sliding assembly, the first conductive pin connected to the positive electrode of the battery and the second conductive pin connected to negative electrode of the battery are located at a same lateral sidewall of the main body, first conductive pin connected to the negative electrode of the battery and the second conductive pin connected to the positive electrode of the battery are located at another same lateral sidewall of the main body, the second conductive pins are adjacent to the insertion hole, and the first conductive pins are away from the insertion hole.

* * * * *